US007890307B2

(12) United States Patent
Geehan et al.

(10) Patent No.: US 7,890,307 B2
(45) **Date of Patent: *Feb. 15, 2011**

(54) METHOD AND APPARATUS FOR DRILLING WASTE DISPOSAL ENGINEERING AND OPERATIONS USING A PROBABILISTIC APPROACH

(75) Inventors: Thomas Geehan, Houston, TX (US); Quanxin Guo, Sugar Land, TX (US)

(73) Assignee: M-I L.L.C., Houston, TX (US)

( * ) Notice: Subject to any disclaimer, the term of this patent is extended or adjusted under 35 U.S.C. 154(b) by 371 days.

This patent is subject to a terminal disclaimer.

(21) Appl. No.: 12/051,676

(22) Filed: Mar. 19, 2008

(65) Prior Publication Data

US 2008/0162094 A1 Jul. 3, 2008

Related U.S. Application Data

(63) Continuation of application No. 10/797,961, filed on Mar. 11, 2004, now Pat. No. 7,440,876.

(51) Int. Cl.
*G06G 7/48* (2006.01)

(52) U.S. Cl. ..... 703/2; 703/9; 703/10; 73/53.01; 702/9; 175/65; 166/250.1

(58) Field of Classification Search ..... 703/2, 703/6, 9, 10; 702/6, 9, 11–13; 166/250.1, 166/272.2; 73/53.01; 175/65
See application file for complete search history.

(56) References Cited

U.S. PATENT DOCUMENTS

| | | | |
|---|---|---|---|
| 5,503,225 | A | 4/1996 | Withers et al. |
| 2002/0033278 | A1 | 3/2002 | Reddoch |
| 2002/0112886 | A1 | 8/2002 | Ward |

OTHER PUBLICATIONS

Technical Report for related Colombian Application No. 06-095.215, dated Nov. 14, 2008, (8 pages).
Technical Report for related Colombian Application No. 06-095.215; dated Apr. 17, 2009 (10 pages).
Office Action in Canadian Patent 2,559,020 mailed Feb. 20, 2008, 5 pages.
Rechard, R.P. "Historical Background on Performance Assessment of the Waste Isolation Pilot Plant," Reliability Engineering and System Safety 69 (2000) p. 5-46.

(Continued)

*Primary Examiner*—Russell Frejd
(74) *Attorney, Agent, or Firm*—Osha Liang LLP

(57) ABSTRACT

A method for determining distribution data for a disposal domain parameter to increase assurance in a cuttings injection process, including performing a fracturing simulation using a site specific datum to obtain a fracturing result, determining a probability of creating a new fracture using the fracturing result and a probability model, performing a plurality of fracturing simulations using the probability and a distribution associated with the probability to obtain disposal domain information, and extracting the distribution data for the disposal domain parameter from the disposal domain information.

16 Claims, 6 Drawing Sheets

OTHER PUBLICATIONS

Keck; "Drill Cuttings Injection: A Review of Major Operations and Technical Issues"; SPE Annual Technical Conference and Exhibition, No. 77553; Sep. 29, 2002; pp. 1-12 (12 pages).

Saasen; "The First Cuttings Injection Operation Worldwide in a Subsea Annulus: Equipment and Operational Experience"; SPE Annual Technical Conference and Exhibition, No. 48985; Sep. 27, 1998; pp. 207-214 (8 pages).

Minton; "Downhole Injection of OBM Cuttings Economical in North Sea"; Oil & Gas Journal, Petroleum Publishing Co., Tulsa, OK; vol. 92, No. 22, May 30, 1994, pp. 75-79 (5 pages).

Reddoch; "Cuttings Re-Injection Must Match Increased Drilling Efficiency—New Technology Assisting in Downhole Disposal"; Offshore, Industrial Publications, Conroe, Texas; vol. 60, No. 9, Sep. 2000; pp. 44-45, 185 (3 pages).

Reddoch; "Successful Drill Cuttings Re-Injection (CRI) Case History on a Subsea Template Utilizing Low Cost Natural Oil Based Mud"; SPE; vol. 30433, Sep. 05, 1995; pp. 1-3 (3 pages).

Minton; "Downhole Cuttings Injection Allows Use of Oil-Base Muds"; World Oil, Gulf Publishing Co.; vol. 213, No. 10, Oct. 1, 1992; pp. 47-48, 50-52 (5 pages).

PCT International Search Report issued in PCT Application No. PCT/US2005/008211 dated Jan. 7, 2005 (5 pages).

PCT Written Opinion issued in PCT Application No. PCT/US2005/008211 dated Jan. 7, 2005 (6 pages).

METHOD AND APPARATUS FOR DRILLING WASTE DISPOSAL ENGINEERING AND OPERATIONS USING A PROBABILISTIC APPROACH

CROSS-REFERENCE TO RELATED APPLICATIONS

This Application is a continuation of U.S. Patent Application No. 10/797,961 now U.S. Pat. No. 7,440,876, filed Mar. 11, 2004, and claims the benefit, pursuant to 35U.S.C. §120, of that Application. That Application is incorporated by reference in its entirety.

BACKGROUND

A cuttings re-injection (CRI) operation involves the collection and transportation of drilling waste (commonly referred to as cuttings) from solid control equipment on a rig to a slurrification unit. The slurrification unit subsequently grinds the cuttings (as needed) into small particles in the presence of a fluid to make a slurry. The slurry is then transferred to a slurry holding tank for conditioning. The conditioning process effects the rheology of the slurry, yielding a "conditioned slurry." The conditioned slurry is pumped into a disposal well, through a casing annulus, into sub-surface fractures in the formation (commonly referred to as the disposal formation) under high pressure. The conditioned slurry is often injected intermittently in batches into the disposal formation. The batch process typically involves injecting roughly the same volumes of conditioned slurry and then waiting for a period of time (e.g., shutting-in time) after each injection. Each batch injection may last from a few hours to several days or even longer, depending upon the batch volume and the injection rate.

The batch processing (i.e., injecting conditioned slurry into the disposal formation and then waiting for a period of time after the injection) allows the fractures to close and dissipates, to a certain extent, the build-up of pressure in the disposal formation. However, the pressure in the disposal formation typically increases due to the presence of the injected solids (i.e., the solids present in the drill cuttings slurry), thereby promoting new fracture creation during subsequent batch injections. The new fractures are typically not aligned with the azimuths of previous existing fractures.

With large-scale CRI operations, release of waste into the environment must be avoided and waste containment must be assured to satisfy stringent governmental regulations. Important containment factors considered during the course of the operations include the following: the location of the injected waste and the mechanisms for storage; the capacity of an injection well or annulus; whether injection should continue in the current zone or in a different zone; whether another disposal well should be drilled; and the required operating parameters necessary for proper waste containment.

Modeling of CRI operations and prediction of disposed waste extent are required to address these containment factors and to ensure the safe and lawful containment of the disposed waste. Modeling and prediction of fracturing is also required to study CRI operation impact on future drilling, such as the required well spacing, formation pressure increase, etc. A thorough understanding of the storage mechanisms in CRI operations is a key for predicting the possible extent of the injected conditioned slurry and for predicting the disposal capacity of an injection well.

One method of determining the storage mechanism is to model the fracturing. Fracturing simulations typically use a deterministic approach. More specifically, for a given set of inputs, there is only one possible result from the fracturing simulation. For example, modeling the formation may provide information about whether a given batch injection will open an existing fracture created from previous injections or start a new fracture. Whether a new fracture is created from a given batch injection and the location/orientation of the new fracture depends on the alternations of local stresses, the initial in-situ stress condition, and the formation strength. One of the necessary conditions for creating a new fracture from a new batch injection is that the shut-in time between batches is long enough for the previous fractures to close. For example, for CRI into low permeability shale formations, single fracture is favored if the shut-in time between batches is short.

Once the required shut-in time for fracture closure is computed from the fracturing simulation, a subsequent batch injection may create a new fracture if the conditions favor creation of a new fracture over the reopening of an existing fracture. This situation can be determined from local stress and pore pressure changes from previous injections, and the formation characteristics. The location and orientation of the new fracture also depends on stress anisotropy. For example, if a strong stress anisotropy is present, then the fractures are closely spaced, however if no stress anisotropy exits, the fractures are widespread. How these fractures are spaced and the changes in shape and extent during the injection history can be the primary factor that determines the disposal capacity of a disposal well.

SUMMARY

In general, in one aspect, the invention relates to a risk-based method for determining distribution data for a disposal domain parameter in a cuttings injection process, comprising performing a fracturing simulation using a site specific datum to obtain a fracturing result, determining a probability of creating a new fracture using the fracturing result and a probability model, performing a plurality of fracturing simulations using the probability and a distribution associated with the probability to obtain disposal domain information, and extracting the distribution data for the disposal domain parameter from the disposal domain information.

In general, in one aspect, the invention relates to a system for determining distribution data for a disposal domain parameter in a cuttings injection process, comprising a probability component configured to obtain a probability of creating a new fracture using a fracturing result and a probability model, an integration module configured to generate at least one input parameter for a fracturing simulation using the probability and further configured to extract distribution data associated with at least one disposal domain parameter from the disposal domain information, and a fracturing simulation component configured to perform the fracturing simulation to generate the disposal domain information using the at least one input parameter.

Other aspects of the invention will be apparent from the following description and the appended claims.

DETAILED DESCRIPTION

Figure 1:
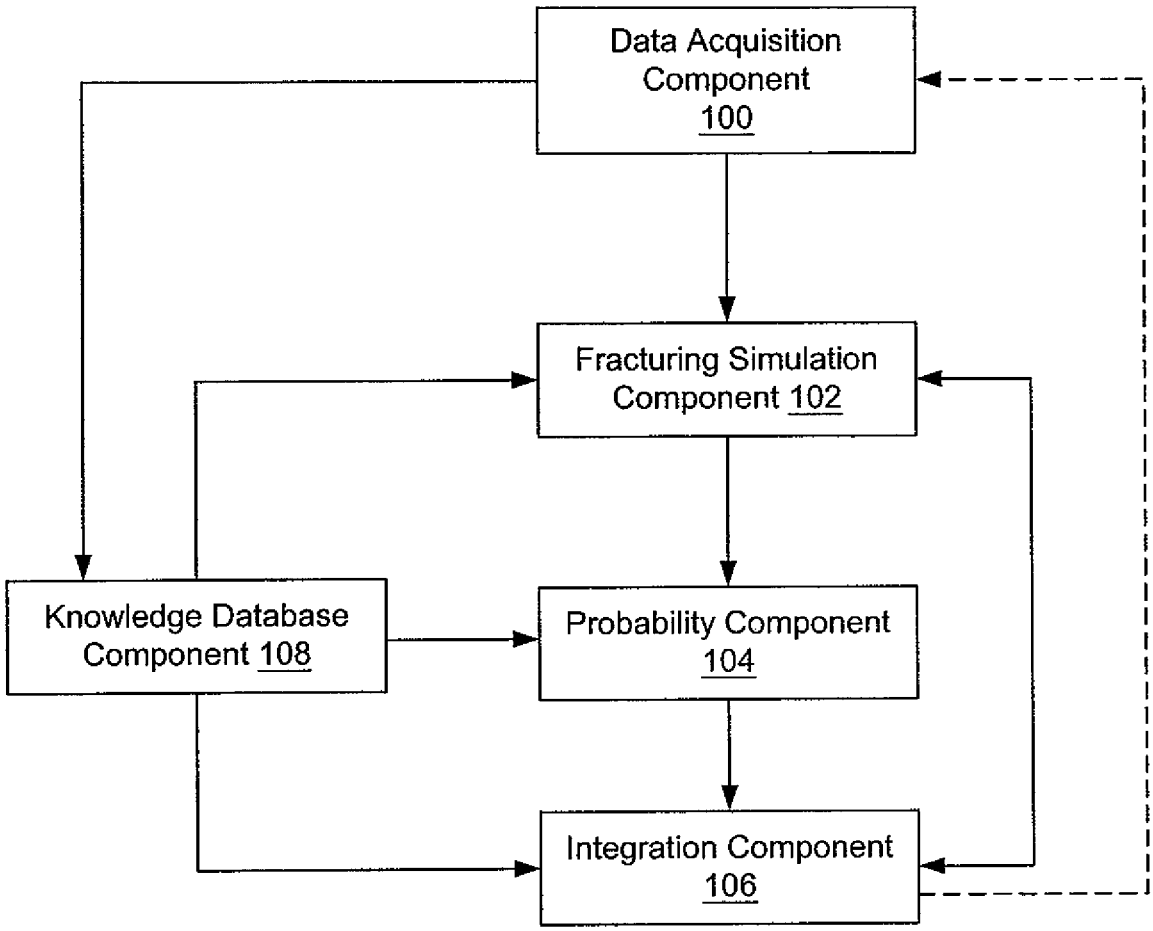
FIG. 1 shows a system in accordance with one embodiment of the invention.

Specific embodiments of the invention will now be described in detail with reference to the accompanying figures. Like elements in the various figures are denoted by like reference numerals for consistency.

In the following detailed description of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

A drilling waste management plan is typically required before a field development drilling program is initiated. However, at this stage little geological information is usually available. Therefore, uncertainties associated with uncertain or unavailable formation data must be assessed quantitatively in the CRI feasibility and engineering evaluation to increase the quality assurance of CRI operations. Accordingly, embodiments of the invention provide a method and apparatus to integrates results from simulation packages with a risk-based approach.

In general, embodiments of the invention relates to method and apparatus for determining operational parameters for cuttings re-injection. More specifically, the invention relates to methods and apparatus for using a probabilistic approach to determine one or more geological and operational parameters for cuttings re-injection. In one embodiment, the probabilistic approach includes using Monte Carlo simulation methodologies in conjunction with a deterministic fracturing simulator to generate a risk-based distribution of operational parameters. The resulting distribution of operational parameters provides a way to assess the inherent uncertainties within a disposal formation and operational parameters. This assessment may then be used to guide decisions such as where disposal wells should be located, how many disposal wells may be required, and the various operational parameters that should be used at the particular disposal well(s).

FIG. 1 shows a system in accordance with one embodiment of the invention. More specifically, FIG. 1 shows an embodiment detailing the various components within the system. As shown in FIG. 1, the system includes a data acquisition (DAQ) and evaluation component (100), a fracturing simulation component (102), a probability component (104), an integration component (106), and a knowledge database component (108). Each of the components is described below.

In one embodiment of the invention, the DAQ component (100) corresponds to both software (e.g., data evaluation software packages) and hardware components (e.g., down hole tools) that are used to gather site specific data (i.e., data about the disposal formation in which the cuttings re-injection wells are to be located). In one embodiment of the invention, the site specific data may include, but is not limited to, formation parameters obtained from logging information and well testing, as well as core tests, etc. The initial site specific data (i.e., data obtained prior to obtaining recommendations about additional site specific data to gather (discussed below)) is used to generate a generic stratigraphy for the formation. Specifically, the initial site specific data provides information about the relevant zones (i.e., sand, shale, etc.) in the disposal formation. The site specific data is used as an input for the fracturing simulation component (102). In addition, the DAQ component (100) also includes functionality (in the form of software components, hardware components, or both) to obtain additional site specific information after the cuttings re-injection has begun.

As noted above, the fracturing simulation component (102) receives the site specific data as input from the DAQ component (100). In addition, the fracturing simulation component (102) may include functionality to allow a user to input additional information about the cuttings re-injection process that is planned to occur at the site. For example, the user may include as input the number of barrels of cuttings to be injected in each batch, the amount of time between injections (i.e., the shut-in time), the formation and the slurry rheological properties, etc. In one embodiment of the invention, methodologies for determining realistic inputs for the aforementioned parameters are defined in the knowledge database (108) (described below). Those skilled in the art will also appreciate that defined values of the individual input parameters may have a particular distribution (e.g., normal, triangular, uniform, lognormal, etc.). The range of values and the distribution may be obtained from the knowledge database (108) (described below).

The fracturing simulation component (102) may use the aforementioned information to simulate the CRI process for one batch including shut-in time. In one embodiment of the invention, a geomechanical hydraulic fracturing model is used to infer the maximum possible fracture dimensions and to provide assistance in developing appropriate CRI operational parameters. In one embodiment of the invention, the hydraulic fracturing caused by CRI may be simulated using a system such as TerraFRAC™ (TerraFRAC is a trademark of TerraTek, Inc.). Those skilled in the art will appreciate that any geomechanical model may be used to model the effect of CRI on the disposal formation. The fracturing simulation component (102) also receives input parameters from the integration component (104) (discussed below).

The results generated from simulating drilling cuttings re-injection are subsequently used as input into the probability component (104). In one embodiment of the invention, the probability component (104) includes functionality to determine the probability of a new fracture opening during a subsequent injection using the results from the fracturing simulation. In one embodiment of the invention, the probability of a new fracture creating is determined on a per-zone basis. Further, in one embodiment of the invention, the probabilities associated with a particular zone are determined using information from the knowledge database component (108) (described below). An embodiment of the operation of the probability component is described below in FIG. 3.

The probability of creating a new fracture is then used as input into the integration component (106). In one embodiment of the invention, the integration component (106) includes functionality to determine the number of fractures created after a given number of cuttings re-injections, the maximum fracture extent, where new fractures may be initiated, how much cuttings re-injection may be pumped into the formation, etc. This information is collectively referred to herein as disposal domain information. The disposal domain information may be expressed as a range.

In one embodiment of the invention, the disposal domain information is determined using a Monte Carlo simulation methodology in conjunction with the probabilities obtained from the probability component (104) and fracturing simulation component (102). An embodiment of the Monte Carlo methodology is described below in FIG. 4.

Figure 5:
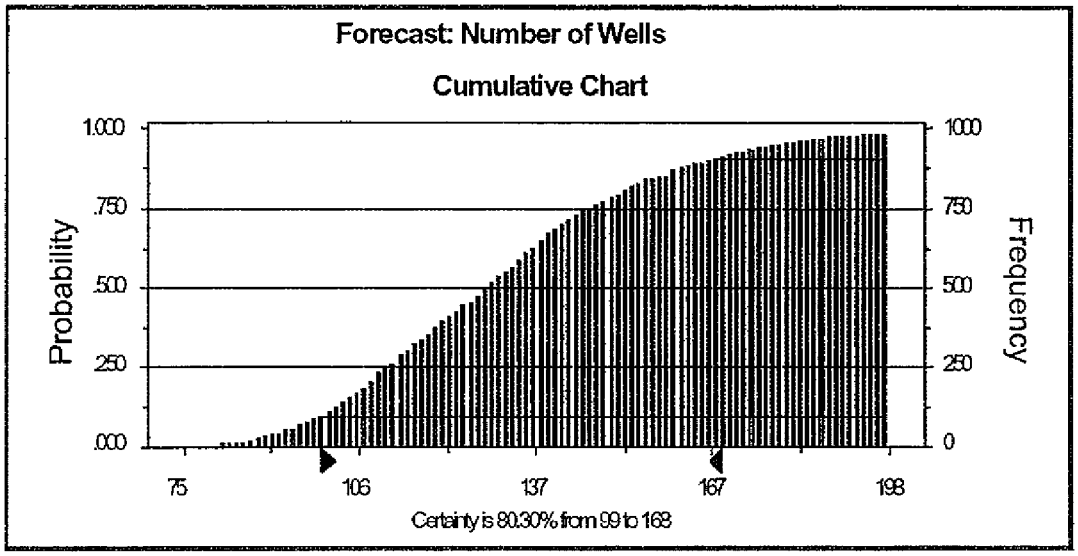
FIG. 5 shows a frequency histogram in accordance with one embodiment of the invention.
Figure 6:
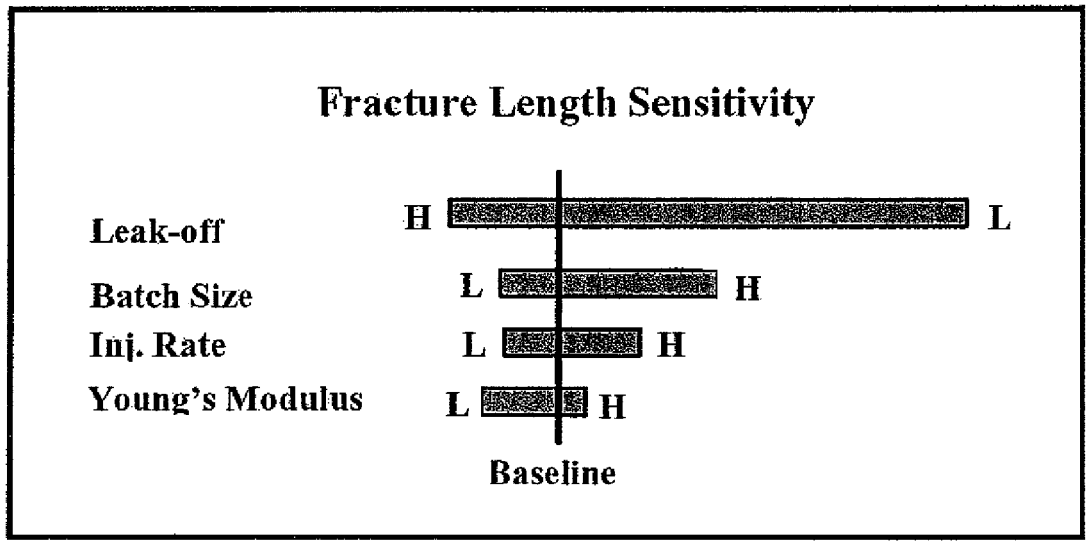
FIG. 6 shows a result of sensitivity study in accordance with one embodiment of the invention.

In one embodiment of the invention, once the disposal domain information has been obtained, the various types of numerical analysis are conducted to determine the distributions of various disposal domain and operational parameters. For example, information about the distribution of fracture half-length, the distribution of the injection pressure, the distribution of the injection pressure increase, the distribution of the well capacity, the distribution of the number of disposal wells that may be required, etc., may be extracted from disposal domain information. An example of the information extracted from the disposal domain information is shown in FIG. 5 (described below). In addition, numerical analysis of the disposal domain information may be used to determine the sensitivity of a particular disposal domain or operational parameter (e.g., fracture length) to different input parameters (e.g., leak-off, batch size, injection rate, Young's modulus, etc.) An example of a sensitivity study is shown in FIG. 6 (described below).

Continuing with FIG. 1, in one embodiment of the invention, the disposal domain and operational parameters obtained via numerical analysis of the disposal domain information may then be compared with various criteria (e.g., does the disposal domain satisfy governmental regulations, operational and containment requirements, etc.) to determine if the disposal domain satisfies the criteria. If the disposal domain satisfies the criteria, then the integration component (106), along with information from the knowledge database (108) (e.g., knowledge regarding best practices, etc.), may be used to generate one or more operational parameters (i.e., batch size, the time between injections, the particle size and slurry rheology requirements, the volume of cuttings to inject into the formation, etc.). In addition, information obtained from sensitivity studies may be used to recommend that additional site specific information be obtained to increase the understanding of the disposal formation.

However, in one embodiment of the invention, if the disposal domain does not satisfy the criteria, then the integration component (106) may include functionality to suggest to the user to obtain additional site specific data (via the DAQ module (100)), or suggest to the user to modify one or more inputs (e.g., zone selection, operational parameters, etc.) for fracturing simulation component (102).

In one embodiment of the invention, the knowledge database is a repository of one or more of the following: site specific data, data about best practices, input parameter distributions, information about the probability of creating a new fracture in a particular zone based on the state of the formation (e.g., did a previous CRI create a fracture that was subsequently closed, did a previous CRI create a fracture that was subsequently closed and screen-out occurred prior to the fracture closing, etc.) The knowledge database component (108) may also include functionality to determine the probabilities associated with creating new fractures upon subsequent injection.

Those skilled in the art will appreciate that the aforementioned components are logical components, i.e., logical groups of software and/or hardware components and tools that perform the aforementioned functionality. Further, those skilled in the art will appreciate that the individual software and/or hardware tools within the individual components are not necessarily connected to one another. In addition, while the interactions between the various components shown in FIG. 1 correspond to transferring information from one component to another component, there is no requirement that the individual components are physically connected to one another. Rather, data may be transferred from one component to another by having a user, for example, obtain a printout of data produced by one component and entering the relevant information into another component via an interface associated with that component. Further, no restrictions exist concerning the physical proximity of the given components within the system.

Figure 2:
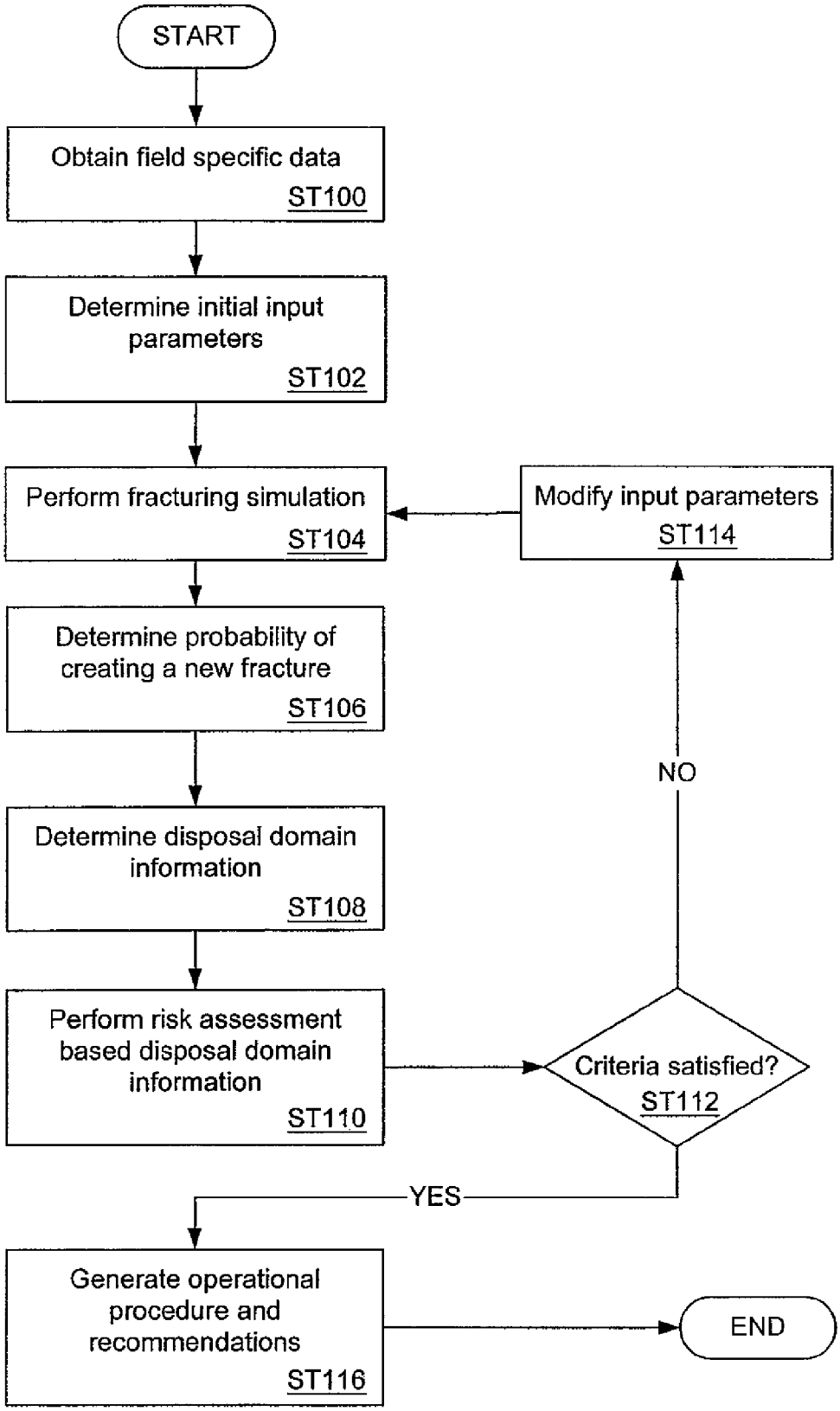
FIGS. 2, 3, and 4 show flowcharts in accordance with one embodiment of the invention.

FIG. 2 shows a flow chart in accordance with one embodiment of the invention. More specifically, FIG. 2 shows a method for determining operational procedures and recommendations for cuttings re-injection at a particular site. Initially, site specific data, including information about formation parameters (e.g., formation pressure, in-situ stresses, rock mechanics, permeability, etc.), is obtained (Step 100). As noted above, the site specific data may include formation characteristics, lithologic sequences, logging signatures, etc. The site specific data is subsequently used to generate initial input parameters for the fracturing simulation (Step 102). In one embodiment of the invention, the initial input parameters may include, but are not limited to, selecting a stratigraphy for the fracturing simulation, determining a target zone for injection, determining the impact of formation pressure, determining fracture gradients, determining formation permeability, etc. In one embodiment of the invention, the initial input parameters are inferred from the site specific parameters. Alternatively, the initial input parameters may be determined, at least in part, from information stored in a knowledge database about surrounding sites and/or sites with similar formation characteristics.

Continuing with FIG. 2, once the initial input parameters have been determined, the initial input parameters are input into a fracturing simulator. A fracturing simulation is subsequently performed (Step 104). In one embodiment of the invention, the fracturing simulation models one batch injection including the subsequent shut-in time. The results generated by fracturing simulation may include information about whether the fracture closed after the injection (i.e., during the shut-in time), information about whether there was screen-out during slurry injection, etc. The results of the fracturing simulation are subsequently used as input into a probability decision tree to determine the probability of creating a new fracture during a subsequent injection (Step 106). An embodiment for determining the probability of creating a new fracture during a subsequent injection is detailed in FIG. 3 (described below).

The probability of creating a new fracture is subsequently used to determine disposal domain information (Step 108). An embodiment for determining the disposal domain information is detailed in FIG. 4 (described below). The disposal domain information is subsequently used to perform a risk assessment based on the disposal domain (Step 110). In one embodiment of the invention, the risk assessment includes using the disposal domain information to determine how CRI will impact the site. For example, the risk assessment may include the impact on surrounding wells, protected aquifers, etc. Further, the risk assessment may include determining a value (typically can be expressed as a monetary value) of a particular site specific datum with respect to increasing operational assurance (i.e., reducing uncertainty for one or more formation parameters, etc., that are used as input parameters). Thus, the risk assessment determines the cost of obtaining additional site specific datum compared to cost of proceeding without the additional site specific datum. Once the risk assessment has been performed, the results are compared against a set of criteria (Step 112). The criteria are typically pre-defined and include cost, drilling parameters, governmental regulations, etc.

If the criteria are satisfied, then the operational procedures and recommendations for the site are generated (Step 116).

The operational procedures may include the suggested size of the particles within the slurry, the rate of injection, the required equipment, operational and monitoring procedures, etc. The recommendations may include the type of site specific data to continue collecting throughout the CRI process for quality control purposes, etc. Continuing with the discussion of FIG. 2, if one or more criteria are not satisfied (Step 112), then the input parameters (e.g., the injection parameters, etc.) are modified (Step 114) and the fracturing simulation is re-run. This process is typically repeated until the criteria are satisfied. In one embodiment of the invention, the modified input parameters may correspond to changing the injection zone.

Figure 3:
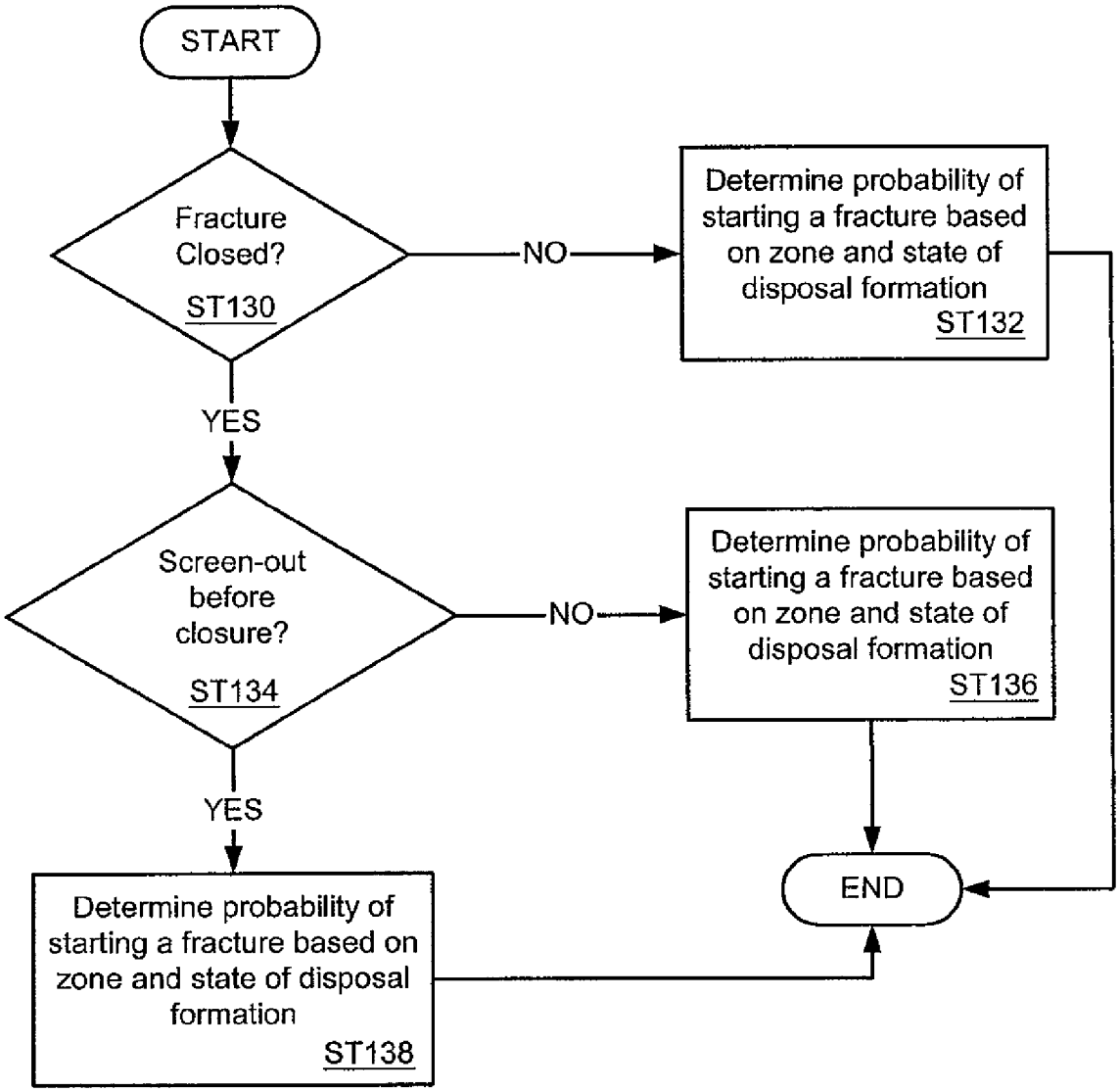

FIG. 3 shows an embodiment of a probability decision tree in accordance with one embodiment of the invention. Initially, a determination is made about whether the fracture is closed before the next injection (Step 130). As noted above, this determination is made based on information received from the fracturing simulation and operational parameters. If the fracture is not closed, then the probability of starting a new fracture, based on the zone and the state of the disposal formation (i.e., previous fracture did not close), is determined (Step 132). Alternatively, if the fracture is closed, then a further determination is made with respect to whether screen-out has occurred prior to closure (Step 134).

If screen-out did not occur prior to closure, then the probability of starting a new fracture, based on the zone and the state of the disposal formation (i.e., previous fracture closed but screen-out did not occur), is determined (Step 136). Alternatively, if screen-out occurred prior to closure, then the probability of starting a new fracture, based on the zone and the state of the disposal formation, is determined (Step 138). Those skilled the in art will appreciate that the probability associated with each zone and state of the disposal formation within each branch of the decision tree (i.e., Steps 130 and 134) may be different. For example, the probability of creating a new fracture during a subsequent injection in a sandstone formation (if the fracture had not closed on the previous injection) may be different than the probability of creating a new fracture during a subsequent injection (if the fracture had closed and screen-out had occurred prior to closure).

As noted above, in one embodiment of the invention, the probability of creating a fracture on a subsequent injection may be determined by conducting numerical analysis studies on site specific data stored within a knowledge database. In one embodiment of the invention, the numerical analysis of the site specific data may result in the generation of a probability model. This probability model may subsequently be used to obtain the probability of opening a new fracture during a subsequent injection based on the injection zone, whether the fracture closed, etc.

In one embodiment of the invention, the disposal domain information corresponds to data resulting from performing the fracturing simulation for a specified number of runs. In general, the disposal domain information may include, but is not limited to, the number of fractures created after a specified number of injections, the maximum fracture extent for each of the fractures within the disposal formation, the shape and location of each of the fractures in the disposal formation, etc. Note that prior to performing a risk assessment analysis on the domain information, the aforementioned domain information may not be readily available from the raw disposal domain information.

Figure 4:
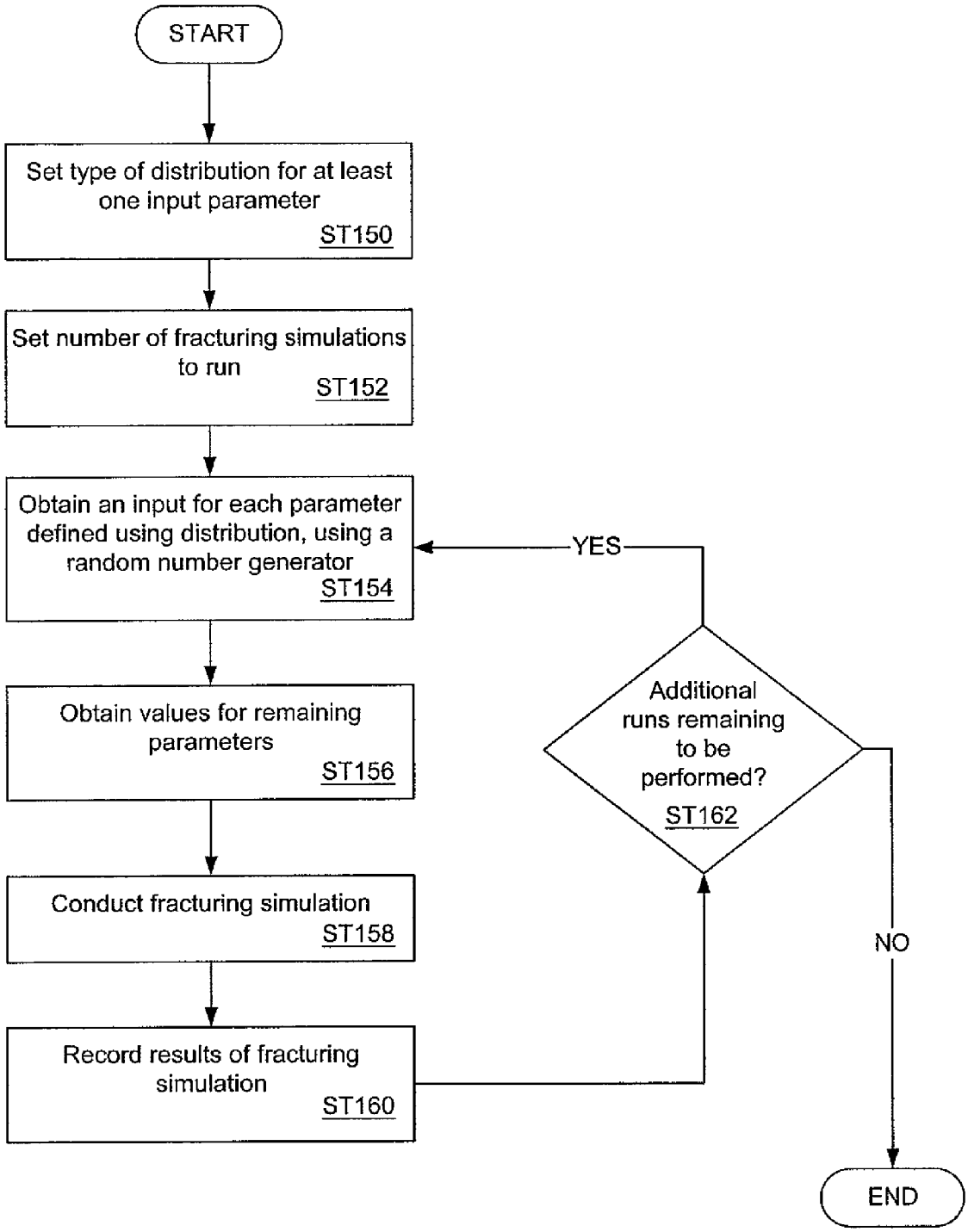

In one embodiment of the invention, the results from the fracturing simulations and uncertainties of geological and operational variables are integrated to obtain disposal domain information. FIG. 4 shows a process for determining disposal domain information in accordance with one embodiment of the invention. More specifically, FIG. 4 shows an embodiment of using a Monte Carlo simulation methodology in conjunction with a deterministic fracturing simulator. Initially, the distribution type is set for each input parameter that is defined using a distribution (Step 150). As noted above, the distribution type may correspond to a normal distribution, a triangular distribution, a uniform distribution, a lognormal distribution, etc. Those skilled in the art will appreciate that the each input parameter defined using a distribution may have a different distribution and distribution type. In one embodiment of the invention, the probability of a new fracture opening during a subsequent CRI is associated with a binomial distribution. No actions are taken with respect to input parameters that are not defined using a distribution. Next, the number of fracturing simulations to run is set (Step 152).

For each simulation run, the following steps are performed. Initially, a value for each input parameter is defined using a distribution is determined using a random number generator (Step 154). In one embodiment of the invention, the random number generator generates a random number, which is subsequently used to select the value for the input parameter that is within the distribution defined for the input parameter. The aforementioned means of selected a value for the input parameter is performed for each input parameter that is defined using a distribution. The same random number may be used to select the value for each of the aforementioned input parameters or a different random number may be used to select the value for each of the aforementioned parameters. Those skilled in the art will appreciate that a pseudo-random number generator may be used in place of a random number generator.

Continuing with the discussion of FIG. 4, the values for the remaining input parameters (i.e., input parameters that are not defined using a distribution) are obtained (Step 156). All the values for the input parameters obtained in Steps 154 and 156 are then input into a fracturing simulator. A fracturing simulation is subsequently conducted (Step 158). The results of the fracturing simulation are subsequently recorded (Step 160). Next, a determination is made whether additional runs remain to be performed (Step 162). If additional runs remain, then Steps 154-162 are repeated. Alternatively, if no additional runs remain, then the gathering of disposal domain information is complete.

Those skilled in the art will appreciate that the method described above for determining the disposal domain information may incorporate one or more of the following assumptions: 1) when a new batch is injected, the injected cuttings may either re-open an existing fracture or initiate a new fracture; and 2) when a new fracture is initiated, only one major fracture is propagating.

As noted above, after all the simulation runs are completed, the resulting disposal domain information may be analyzed using numerical analysis tools to extract distribution data from the disposal domain information. Specifically, in one embodiment of the invention, the disposal domain information obtained from each of the simulation runs may be analyzed for distribution data corresponding to a particular disposal domain parameter from the fracture simulation. The distribution data corresponding to a particular disposal domain parameter may then be represented using, for example, a histogram. In one embodiment of the invention, disposal domain parameters may include injection pressure increase, well capacity, fracture length, etc.

FIG. 5 shows a cumulative frequency histogram in accordance with one embodiment of the invention. Specifically, the histogram shown in FIG. 5 illustrates that there is an 80.30% certainty that disposal well can store drilling cuttings generated from drilling 99 to 168 wells. In addition, the histogram indicates that less than 10% probability exists that the disposal well will be full after injecting drilling cuttings of less than 100, a 50% probability exists that the disposal well can store drilling cutting resulting from the drilling of 128 wells, and a 90% probability exists that the disposal well can not store drilling cuttings resulting from the drilling of more than 168 wells. Similar information may be extracted from the disposal domain information relating to injection pressure increase, fracture length, etc.

In addition, sensitivity information may also be extracted from the disposal domain information. FIG. 6 shows a result of sensitivity study in accordance with one embodiment of the invention. In this particular embodiment, a fracture length sensitivity study was conducted. FIG. 6 shows that fracture length for this particular disposal formation is very sensitive to leak-off.

Those skilled in the art will appreciate that typically in order to perform a sensitivity study only one input parameter may be varied at time while keeping the other input parameters constant. Thus, Steps 154 and 156 of FIG. 4 may need to be modified such that the value for only one input parameter is determined/obtained while the other input parameters remain constant.

As noted above, the results of the sensitivity study may result in a recommendation to obtain additional site specific data for the particularly sensitive input of the disposal domain parameter (in this case fracture length) or operational parameter. Alternatively, additional numerical analysis may be performed on the disposal domain information to ascertain the relationship between the input parameter and the disposal domain and/or operational parameter.

In one embodiment of the invention, the distribution data extracted from the disposal domain information is used to perform a risk assessment for the particular disposal formation. Specifically, the distribution information may provide a means for a company interested in using CRI for disposing waste material to quantify the uncertainty inherent in CRI and thereby make an informed decision about whether to proceed. In particular, by quantifying the uncertainty, a company may assess the best and worst case scenarios in terms of cost, governmental issues, etc., and determine whether CRI is the appropriate means to dispose of waste at the site.

Further, the distribution data and sensitivity data may be used to guide follow-up site specific data gathering operations (e.g., logging, well testing, monitoring, etc.) to obtain more information about a particular formation parameter with significant impact on the behavior of the disposal formation with respect to CRI. In addition, the distribution information may provide an operator with valuable insight into proper operation of the CRI equipment at the site.

Figure 7:
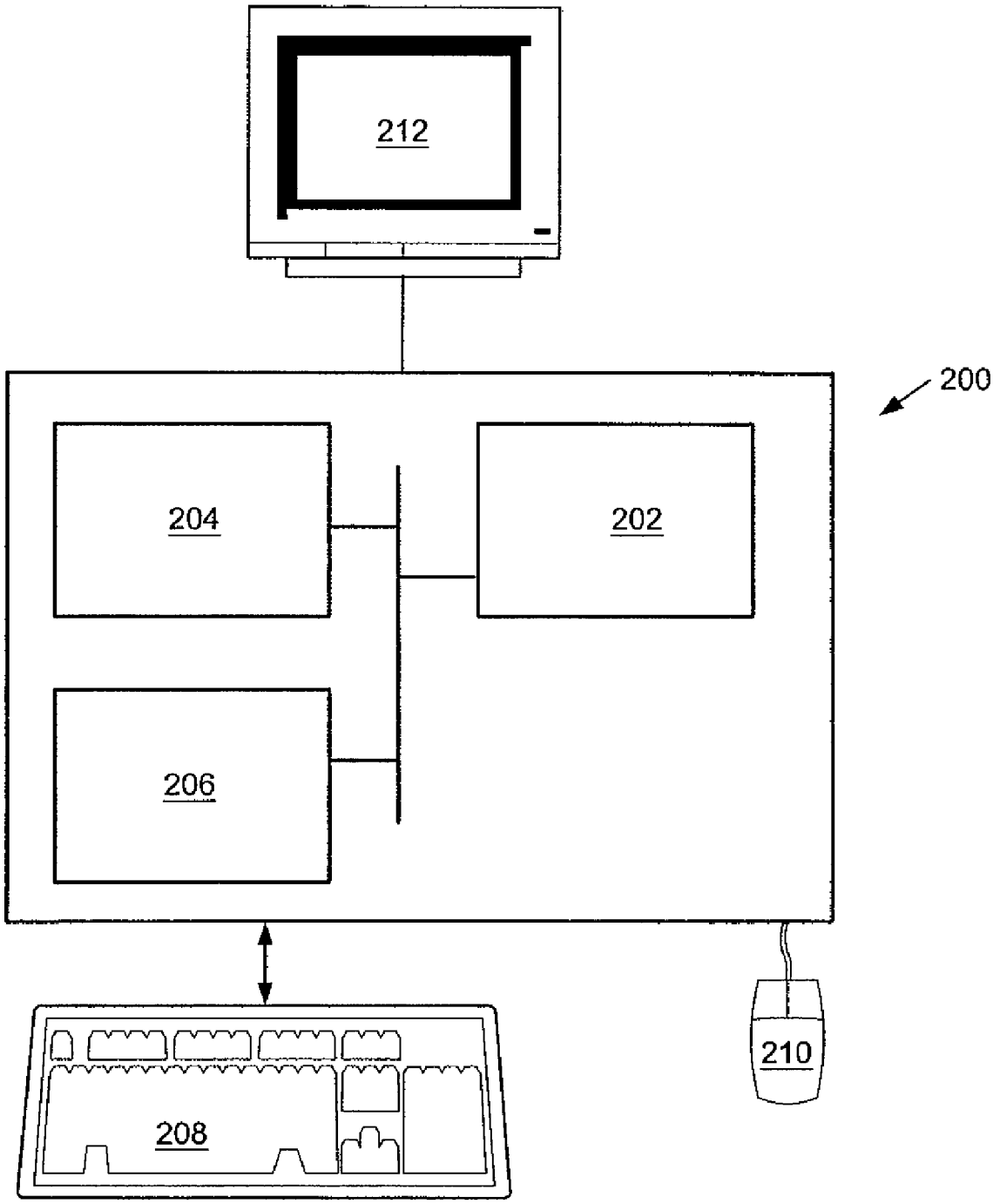
FIG. 7 shows a computer system in accordance with one embodiment of the invention.

The invention may be implemented on virtually any type of computer regardless of the platform being used. For example, as shown in FIG. 7, a networked computer system (200) includes a processor (202), associated memory (204), a storage device (206), and numerous other elements and functionalities typical of today's computers (not shown). The networked computer (200) may also include input means, such as a keyboard (208) and a mouse (210), and output means, such as a monitor (212). The networked computer system (200) is connected to a local area network (LAN) or a wide area network (e.g., the Internet) via a network interface connection (not shown). Those skilled in the art will appreciate that these input and output means may take other forms. Further, those skilled in the art will appreciate that one or more elements of the aforementioned computer (200) may be located at a remote location and connected to the other elements over a network or satellite.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of determining disposal domain information for a cuttings injection process at a site, comprising:

performing a first fracturing simulation using a site specific datum to obtain a first fracturing result;

determining a probability of creating a new fracture in a formation at the site using the first fracturing result and a probability model;

performing a plurality of fracturing simulations to obtain the disposal domain information, wherein the performing a plurality of fracturing simulations comprises:

assigning a type of distribution for the probability of creating the new fracture in the formation at the site, selecting a first value for the probability of creating the new fracture in the formation at the site using the type of distribution running a second fracturing simulation using the first value as input to obtain a second fracturing result, wherein the second fracturing simulation is one of the plurality of fracturing simulations, and determining the disposal domain information using the second fracturing result; and generating an operational parameter for the cuttings injection process at the site using the disposal domain information.

2. The method of claim 1, further comprising:

performing a risk assessment analysis for the site using the disposal domain information to obtain a risk assessment.

3. The method of claim 2, further comprising:

determining whether the disposal domain information satisfies a criterion using the risk assessment.

4. The method of claim 3, wherein the criterion is at least one selected from a group consisting of a governmental regulation and a cost criteria.

5. The method of claim 1, wherein performing the plurality of fracturing simulations to obtain the disposal domain information further comprises:

selecting a second value for the probability of creating the new fracture in the formation at the site using the type of distribution, and running a third fracturing simulation using the second value as input to obtain a third fracturing result, wherein the third fracturing simulation is one of the plurality of simulations, wherein the disposal domain information is further determined using the third fracturing result.

6. The method of claim 5, wherein the first value and the second value are within the type of distribution assigned to the probability of creating the new fracture in the formation at the site.

7. The method of claim 1, wherein the type of distribution is one selected from a group consisting of a normal distribution, a triangular distribution, a uniform distribution, a log-normal distribution, and a binomial distribution.

8. The method of claim 1, wherein the disposal domain information includes at least one selected from a group consisting of a number of factures created after a specified number injections, a maximum fracture extent for each fracture within the formation, a shape of a fracture within the formation, and the location of a fracture in the formation.

9. The method of claim 1, wherein a random number generator generates a random number which is used to select the first value.

10. The method of claim 1, further comprising:

extracting sensitivity study information associated with a disposal domain parameter from the disposal domain information.

11. The method of claim 10, wherein the disposal domain parameter comprises at least one selected from the group consisting of disposal zone selection, fracturing length, number of disposal wells, injection pressure increase, and disposal well capacity.

12. The method of claim 1, wherein the probability model comprises a probability-based decision tree comprising at least one probability value.

13. The method of claim 12, wherein using the probability-based decision tree comprises:

using the first fracturing result and a formation property to:

determine the probability of creating the new fracture if the fracture is not closed;

determine the probability of creating the new fracture if the fracture is closed and no screen-out occurs prior to closure; and determine the probability of creating the new fracture if the fracture is closed and screen-out occurs prior to closure.

14. The method of claim 12, wherein the at least one probability value is associated with an injection zone.

15. The method of claim 12, wherein the probability value is obtained from a database of field data.

16. The method of claim 1, wherein performing the plurality of fracturing simulations comprises using a Monte Carlo simulation methodology.

* * * * *